United States Patent [19]

Lo Duca

[11] Patent Number: 4,890,789

[45] Date of Patent: Jan. 2, 1990

[54] BOX STRUCTURE WITH INCREASED RESISTANCE TO BASE OPENING

[75] Inventor: Carmelo Lo Duca, Milan, Italy

[73] Assignee: Gl.Bl.Effe. S.R.L, Milan, Italy

[21] Appl. No.: 274,007

[22] Filed: Nov. 21, 1988

[30] Foreign Application Priority Data

Nov. 27, 1987 [IT] Italy ..... 22805 A/87

[51] Int. Cl.[4] ..... B65D 5/10

[52] U.S. Cl. ..... 229/102; 229/152; 229/153; 229/183; 229/185

[58] Field of Search ..... 206/807; 229/102, 152, 229/153, 183, 185

[56] References Cited

U.S. PATENT DOCUMENTS

| | | | |
|---|---|---|---|
| 1,566,196 | 12/1925 | Garcia | 206/807 X |
| 1,989,659 | 3/1935 | Adsit et al. | 229/153 |
| 2,039,315 | 5/1936 | Heineman | 229/152 X |
| 2,116,652 | 5/1938 | Adler | 229/153 X |
| 3,578,154 | 5/1971 | Martelli | 229/153 X |
| 4,535,929 | 8/1985 | Sherman, II et al. | 206/807 X |
| 4,752,028 | 6/1988 | Ogura | 229/153 X |
| 4,770,338 | 9/1988 | Tatusch | 206/807 X |

FOREIGN PATENT DOCUMENTS

| | | | |
|---|---|---|---|
| 0629053 | 10/1961 | Canada | 229/152 |
| 1065009 | 5/1954 | France | 229/152 |

*Primary Examiner*—Stephen Marcus
*Assistant Examiner*—Kathryn M. Stemann
*Attorney, Agent, or Firm*—Ladas & Parry

[57] ABSTRACT

A box structure with increased resistance to the opening of its base due to the weight of its contents has in the closure tab for its base a shaped notch which when the box is closed forms a slot parallel and adjacent to the folding line of said tab. From each of the relative box closure tabs, in correspondence with said slot, there projects a tooth which extends to touch the inner side wall of the box, the width of said teeth being just smaller than the length of the slot.

1 Claim, 1 Drawing Sheet

BOX STRUCTURE WITH INCREASED RESISTANCE TO BASE OPENING

DESCRIPTION

This invention relates to a box structure with increased resistance to accidental opening of its base due to the weight of its contents.

Boxes for bottles or the like are known consisting of a punched sheet element composed of first side-by-side portions separated by folding lines variously disposed according to the shape of the box to be obtained. In the case of a parallelpiped box these folding lines are parallel to each other. The first portions are foldable along the folding lines to form the side surface of the box, a second portion being provided at one end of a first portion and foldable along the line of separation between the second portion and the relative first portion to form the base of the box. This second portion has a foldable closure tab which when the box has been formed is contained within the box itself. There are usually two second portions, one for each end of the first considered portion, to obtain both the lid and base of the box in the same manner. Generally, at their two opposing ends close to the box lid or base, two of the first portions not associated with second portions comprise cover tabs foldable towards the interior of the box so that when the box is closed they are superposed internally on the base and lid respectively.

To form the box, a lateral tab of a first portion situated at one end of the sheet element is used, this lateral tab being glued or stapled to the free edge of the first portion situated at the opposite end of the sheet element, the tab then being usually inside the box.

If these boxes are to contain objects of some weight, the strength of their base must be increased to prevent accidental opening of said base.

To obtain this result a second portion which forms the box base is usually glued to said cover tabs internally superposed on them. These known types of box have however the serious drawback that said base gluing operation considerably increases the time required for forming the box so that its cost is increased substantially, especially when viewed in relation to the extremely low cost of the material of which the box is made and of the punching operation.

Utility model No. 23637B/86 partly solves the problem of cost reduction by providing a box structure able to prevent accidental opening of the base while allowing the box to be formed in a short time.

This result is obtained by providing in said portion a shaped incision defining at least one fixing tab foldable inwards about the folding line of the closure tab relative to said second portion and internally superposable on the relative said cover tabs which are themselves internally superposed on the relative second portion which forms the box base.

Although as stated the box formation time is reduced, the described box structure still has the serious drawback that after the box has been formed it is necessary, either manually or using a suitable automatic device, to fold said fixing tab inwards to superpose it internally on said cover tabs.

According to an improvement of the described structure, the lateral edge of the cover tabs which when the box is formed are facing the fixing tab have an inclination greater than that of the opposite edge of the same cover tab. This facilitates inward folding of the fixing tab. However, to prevent this greater inclination making the superposing zone between the fixing tab and the pair of cover tabs too small, after a certain length with greater inclination, this length being sufficient to facilitate folding of the fixing tab, the requisite edge of the cover tab is provided with a projection to increase said superposing zone. The present invention provides a box structure of increased resistance to base opening, which does not require the aforesaid operation and thus results in substantial time saving. The overall result is a substantial reduction in box production costs.

The box structure according to the invention consists of a punched sheet element formed from four side-by-side first portions separated transversely by folding lines to form the side surface of the prismatic-shaped box, and with at least one second portion at a longitudinal end of one of said first portions and separated therefrom by a folding line to form the box base, at least two of the remaining first portions comprising, at their longitudinal end and on the same side as said second portion, foldable cover tabs internally superposable on said base, the second portion being provided at its farthest end with a foldable closure tab, characterised in that in said closure tab there is provided a shaped notch which when the box is closed forms a slot parallel and adjacent to the fold line of the closure tab, from each of the relative two cover tabs, in correspondence with said slot, there projecting a tooth which touches the inner side wall of the box when this is closed, the overall width of said teeth when the cover tabs are closed being just smaller than the length of said slot.

In this manner, when the box is closed, the edge of the closure tab projects inwards and said teeth snap behind and into said slot in the closure tab. This is sufficient to keep the box base closed even when the weight of the contents acts on it.

The invention will be more apparent from the description of a preferred embodiment thereof given hereinafter by way of non-limiting example. In this description reference will be made to the accompanying drawing in which.

Figure 1:
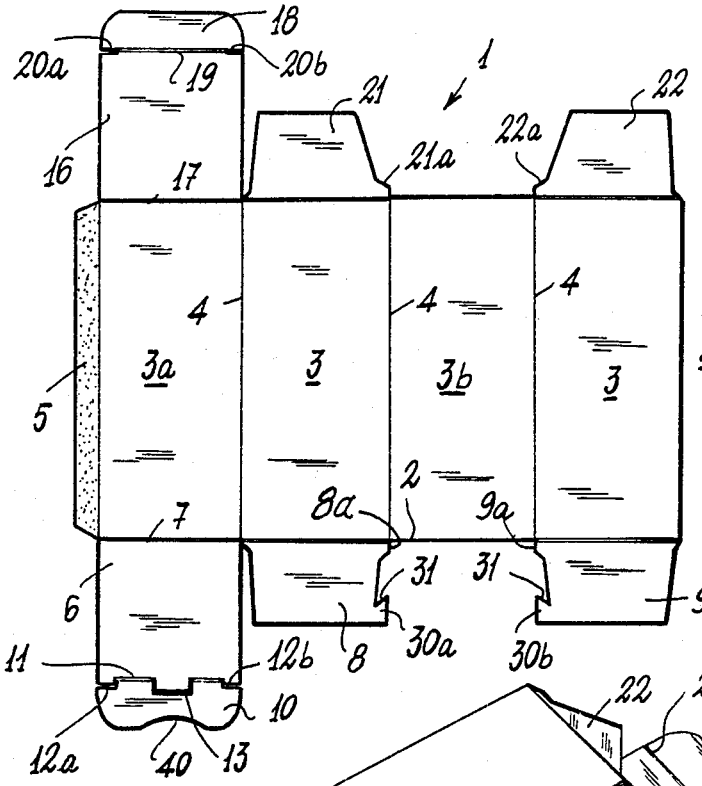
FIG. 1 is a plan view of a punched sheet element forming the box structure according to the invention.
Figure 2:
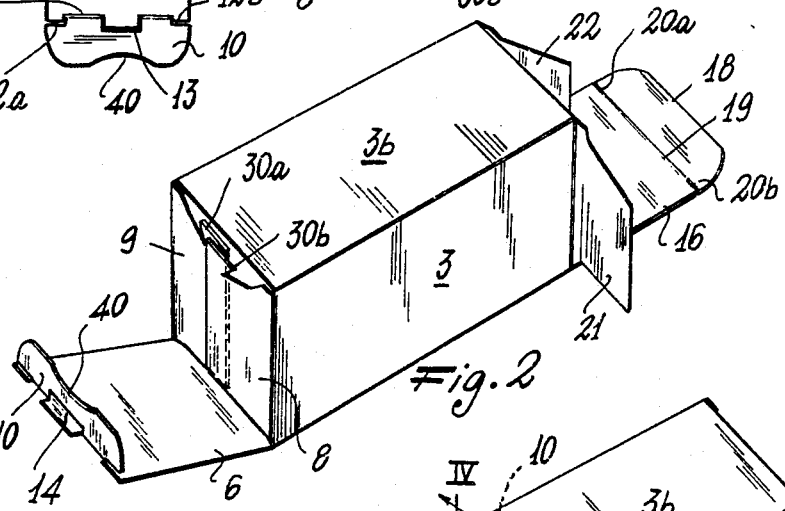
FIG. 2 is a perspective view of the box open at its two ends.
Figure 3:
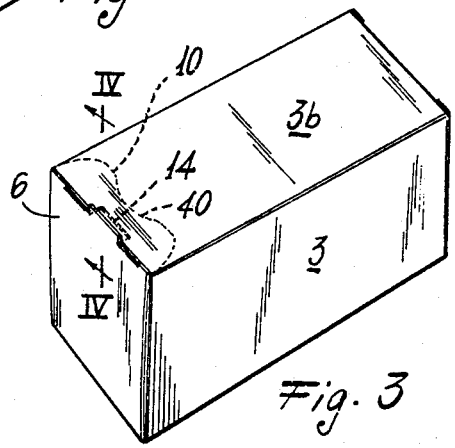
FIG. 3 is a perspective view of the closed box.

With reference to FIG. 1, the box structure comprises a sheet element 1, usually of paper material, punched with folding lines which divide it into various portions. The sheet element 1 comprises four first portions 3, **3*a* and 3*b* side-by-side in a transverse direction and separated by parallel folding lines 4 to form the side surfaces of the box (as shown in FIGS. 2 and 3) when the appendix 5 is fixed, glued or stapled to the opposite end of the sheet element 1**.

From a longitudinal end of the first portion **3*a* there extends a second portion 6 separated from the first portion 3*a* by a folding line 7 orthogonal to the folding lines 4**, to form the base of the box.

At those longitudinal edges on the same side as the portion 6, the first portions 3 comprise cover tabs 8 and 9 foldable along the lines 2.

The second portion 6 further comprises a closure tab 10 foldable along the line 11 parallel to the folding line 7, and containing at its longitudinal ends a pair of notches 12*a* and 12*b* engageable with teeth 8*a* and 9*a* provided on the cover tabs 8 and 9.

According to the invention, the closure tab 10 comprises a shaped notch 13 which when the tab 10 is folded forms a slot 14 of a certain length (FIG. 2).

The cover tabs 8 and 9 each comprise a projecting tooth 30*a* and 30*b* respectively.

The length of the cover tabs 8 or 9 is such that when the teeth 30*a* and 30*b* are folded they are partially superposed. The teeth 30*a* and 30*b* have their inner side 31 reentering in the manner of a saw tooth.

Figure 4:
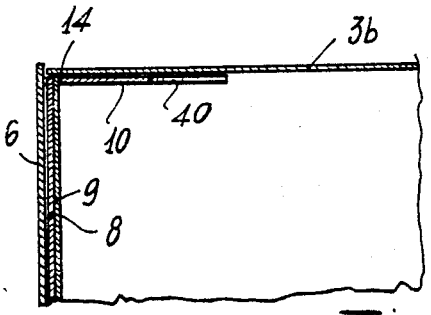
FIG. 4 is an enlarged partial longitudinal section through the box on the line IV—IV of FIG. 3.

The closure tab 10 has a central curved recess 40 so that when the base is closed and the edge of the tab 10 abuts on the superposed teeth 30*a* and 30*b*, the curved recess 40 facilitates the centering of said teeth, so that when these latter deform towards the inside of the box they are already in the correct position for snapping into the slot 14, as seen in FIG. 4.

The sawtoothed shape of the teeth 30*a* and 30*b* means that they are more securely retained in the slot 14. The length of the teeth 30*a* and 30*b* must clearly be less than the length of the slot 14. However to obtain good resistance to accidental opening of the base, the overall width of the teeth when superposed must be just less than the length of the slot. The width of this latter must obviously be such as to allow the introduction of the two superposed teeth.

For completeness of description it should be noted that on that side of the first portion distant from the second portion 6 there is provided another portion 16 which forms the box lid and is foldable along a line 17 orthogonal to the lines 4. The second portion 16 also comprises along its side distant from the portion 3*a* a tab 18 which is foldable along a line 19 and is provided with a pair of notches 20*a* and 20*b* at its ends, similar to those already described for the tab 10.

In an entirely similar manner to that already described, on that side of the first portions 3 distant from the cover tabs 8 and 9 there are defined further cover tabs 21 and 22 with zones 21*a* and 22*a* engageable with the pair of notches 20*a* and 20*b*.

Advantageously, the second portion 16 and the cover tabs 21 and 22 can be shaped as the second portion 6 and cover tabs 8 and 9 respectively, ie the box lid can have an identical closure system to that used for the base. In this case besides preventing accidental escape of the object contained in the box in the case of inversion during packing and despatch, a closure system is obtained which acts as a guarantee in that it requires the lid to be torn off by the user to gain access to the object.

In the described embodiment, the second portions (6 and 16) and the cover tabs (8 and 21, 9 and 22) on both sides of the box structure are attached to the same first portion (3*a* and 3 respectively), to form that which in this field is known as an "aeroplane" structure. Obviously the second portions and the cover tabs of one side could be attached instead to main parts other than those of the other side, to form that known as an "alternate flap" structure.

It has been found in practice that the box with the structure according to the invention completely attains the stated object by providing excellent resistance to base opening without requiring gluing operations.

A further advantage is that it can be assembled in a very short time at low cost.

In practice the materials used and the dimensions can be chosen according to requirements and the state of the art.

I claim:

1. A box structure with increased resistance to base opening, consisting of a punched sheet element formed from four side-by-side first portions separated transversely by folding lines to form a side surface of a prismatic-shaped box, and with at least one second portion at a longitudinal end of one of said first portions and separated therefrom by a folding line to form a box base, at least two of the remaining first portions comprising, at their longitudinal end and on the same side of said punched sheet element as said second portion, foldable cover tabs internally superposable on said base, the second portion being provided at its farthest end with a foldable closure tab characterized in that said closure tab has a central curved recess, the closure tab comprising a shaped notch which when the box is closed forms a slot parallel and adjacent to a folding line of the closure tab, in correspondence with said slot there projects from each of the relative two cover tabs a tooth which touches an inner side wall of the box when this is closed, the overall width of said teeth when the cover tabs are closed being just smaller than the length of said slot, the teeth having an inner side thereof reentering in the manner of a sawtooth.

* * * * *